US005654515A

United States Patent [19]

Youse

[11] Patent Number: 5,654,515

[45] Date of Patent: Aug. 5, 1997

[54] PIANO KEY LEVELING

[75] Inventor: William S. Youse, Hewlett, N.Y.

[73] Assignee: Steinway, Inc., Waltham, Mass.

[21] Appl. No.: 531,138

[22] Filed: Sep. 19, 1995

[51] Int. Cl.[6] ..... G10C 3/12

[52] U.S. Cl. ..... 84/433; 84/435

[58] Field of Search ..... 84/433, 439, 434, 84/438, 435

[56] References Cited

U.S. PATENT DOCUMENTS

| | | | |
|---|---|---|---|
| 509,915 | 12/1893 | Lehr et al. | 84/433 |
| 2,482,619 | 9/1949 | Howe | 84/433 |

*Primary Examiner*—Cassandra C. Spyrou
*Attorney, Agent, or Firm*—Fish & Richardson, P.C.

[57] ABSTRACT

A piano includes a balance rail defining a balance surface, and a piano key assembly including an elongated body defining a playing surface. The piano key assembly is supported by the balance surface for pivoting movement in response to application of playing pressure applied to the playing surface. The balance surface is disposed in a first plane and the playing surface is disposed in a second plane vertically spaced from the first plane. A leveling arm has a first end attached to the elongated body and a cantilevered, second, free end, and defines a leveling surface in opposition to the balance surface. A leveling adjustment element includes a segment extending between the elongated body and the free end of the leveling arm. The segment has a length adjustable for changing the vertical distance between the first plane of the balance surface and the second plane of the playing surface.

6 Claims, 3 Drawing Sheets

PIANO KEY LEVELING

BACKGROUND OF THE INVENTION

This invention relates to pianos and piano keys.

In the manufacture and maintenance of pianos, piano keys are leveled at a predetermined height with respect to the key bed. The prior art method currently in use for leveling piano keys includes selecting two natural (white) keys (usually the keys at the opposite farthest ends of the keyboard) as guide keys and adjusting these keys with respect to the piano key bed using a gauge or measuring device. The remaining keys on the keyboard are then aligned to the guide keys.

Referring to FIG. 1, in which the prior art key leveling technique is illustrated, paper punchings 104 of varying thicknesses are used to adjust the height of key 100 with respect to key bed 102. The paper punchings are placed between the balance rail 106 of the piano and a bearing 108 upon which key 100 is supported. To access balance rail 106, the action stack (one component 110 of the action stack is shown) and keyboard are removed from the piano, and the action stack is removed from the keyboard. Key 100 and bearing 108 are then removed from balance rail 106, and paper punchings 104 are added or removed. The bearing, key and action stack are then replaced, and the assembly is reinstalled in the piano. The height of key 100 with respect to key bed 102 is then checked. If the height is not correct, the process is repeated until the key is level. Both guide keys are leveled in this manner; then, using a straight edge, laser, sensor or by eyeing, the rest of the keys are adjusted by repeating the steps described above until proper key leveling is achieved for all eighty-eight keys. This process must often be repeated several times, each time allowing time for the wood, felt and paper components of the keyboard to compress and settle. In addition, regular maintenance is required as these parts wear and become further compressed.

This method of key leveling has several drawbacks, including that a seasoned technician requires approximately forty-five minutes to accomplish a single pass at key leveling, which makes the process very time consuming and labor intensive. The repeated removal and replacement of the key sticks can also cause enlargement of the balance rail pin hole in the key stick, resulting in key chucking (back and forward motion of the key) which may in turn cause unstable regulation, inconsistent touch and unwanted noise. The repeated removal and replacement of the action stack may also wear and strip the action hanger screws. Additionally, given the very nature of the method, even a modicum of accuracy is difficult to achieve.

SUMMARY OF THE INVENTION

According to the invention, a piano comprises a balance rail defining a balance surface, and at least one piano key assembly comprising an elongated body having a first key end defining a playing surface and an opposite, second key end positioned for actuation of a piano hammer. The piano key assembly is supported by the balance surface of the balance rail for pivoting movement in response to application of playing pressure applied to the playing surface. The balance surface is disposed in a first plane and the playing surface is disposed in a second plane spaced from the first plane at a vertical distance. A piano key leveling arm has a first arm end attached to the elongated body and a cantilevered, second, free arm end. The piano key leveling arm defines a leveling surface in a region generally between the first key end and the second key end, and in a region between the first arm end and the second arm end, in opposition to the balance surface of the balance rail. A piano key leveling adjustment element comprises a segment extending generally between the elongated body and the free arm end of the piano key leveling arm. The segment has a length adjustable for changing the vertical distance between the first plane of the balance surface and the second plane of the playing surface.

Preferred embodiments of the invention may include one or more of the following additional features. The leveling surface is an undersurface of the piano key leveling arm, and disposed generally beneath the elongated body. The piano key leveling adjustment element comprises a screw disposed in threaded engagement with the elongated body, the length of the segment of the screw extending between the body and the free arm end of the piano key leveling arm is adjustable by rotation of the screw. The balance surface is defined by an upper surface of a bearing mounted to the balance rail between the balance rail and the piano key leveling arm. The bearing is integrally molded with the balance rail.

According to another aspect of the invention, a method of leveling a piano key comprises providing the piano and at least one piano key assembly described above and adjusting the piano key leveling adjustment element to level the piano key.

These and other features and advantages of the invention will be apparent from the following description of a presently preferred embodiment and from the claims.

DESCRIPTION OF THE PRESENTLY PREFERRED EMBODIMENT

Figure 2:
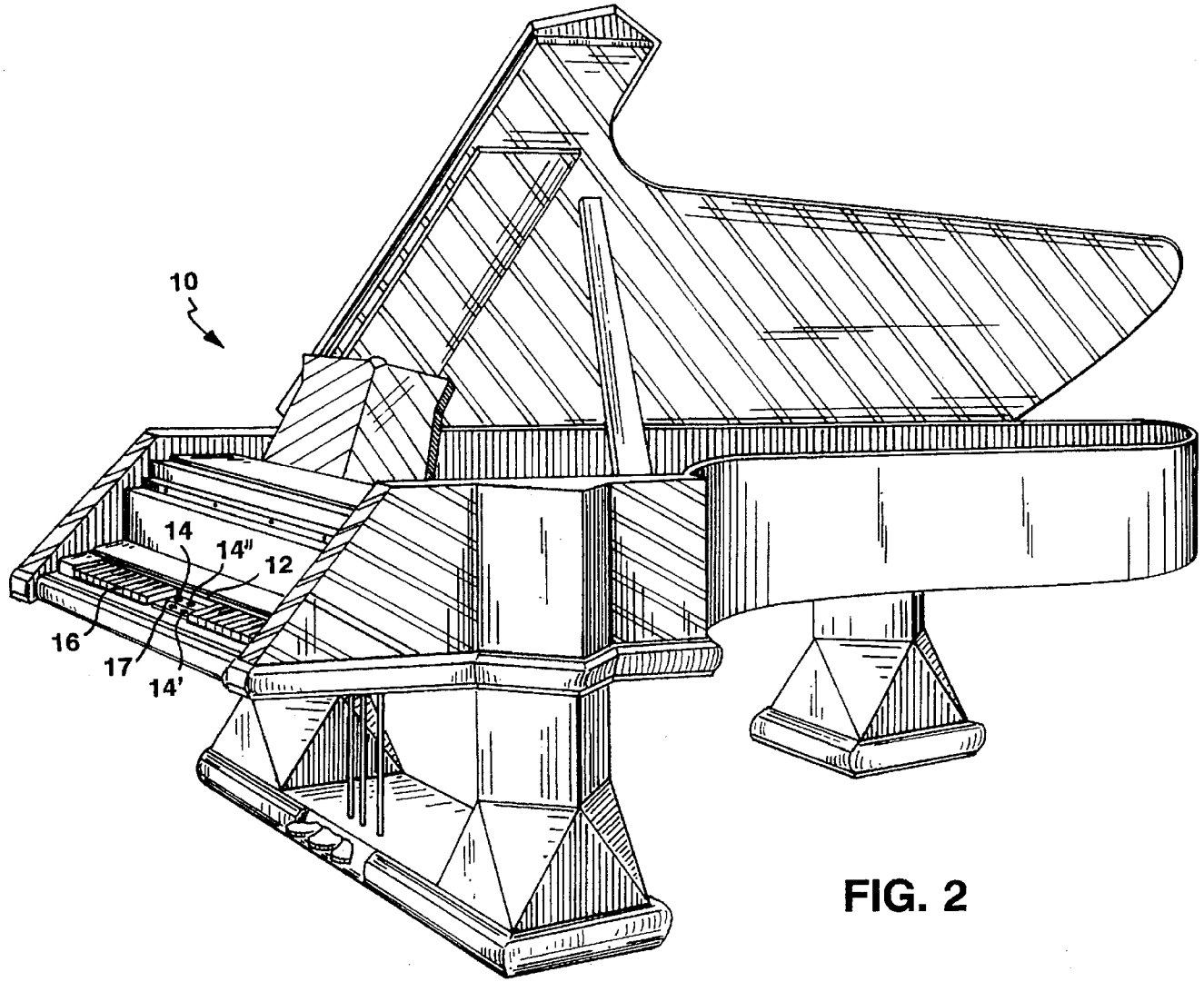
FIG. 2 is a perspective view of a piano with key leveling according to the invention.

Referring to FIG. 2, a piano 10 with key leveling of the invention includes a balance rail 12 having balance surfaces, e.g., accelerator bearings 14, for supporting keys 16. Preferably, a felt strip 17 is mounted on balance rail 12 running along accelerator bearings 14 between front and rear bearing 14', 14" (front bearing 14' supporting an ivory key and rear bearing 14" supporting an ebony key) to prevent bearings 14 from spinning or turning. Alternatively, bearings 14 may be integrally molded with balance rail 12.

Figure 1:
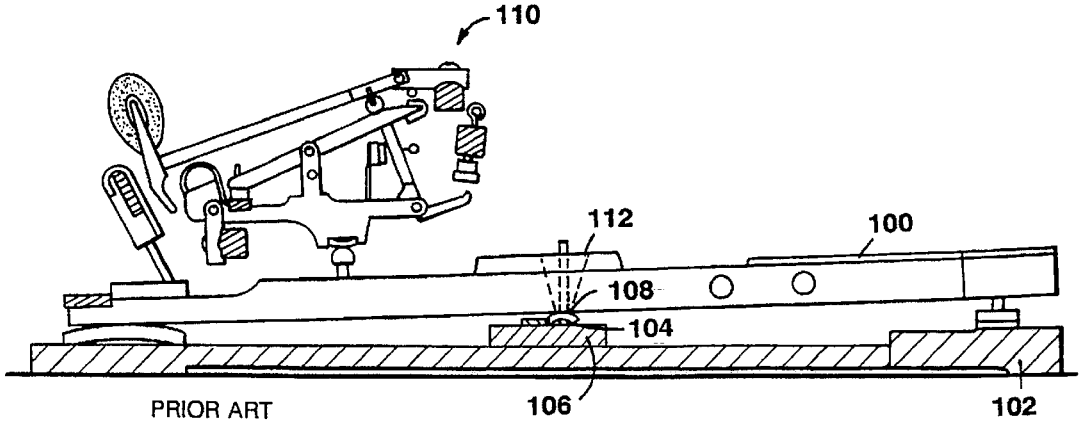
PRIOR ART FIG. 1
FIG. 1 is a side view, partially in section, of a prior art piano key with key leveling, mounted in a piano.
Figure 3:
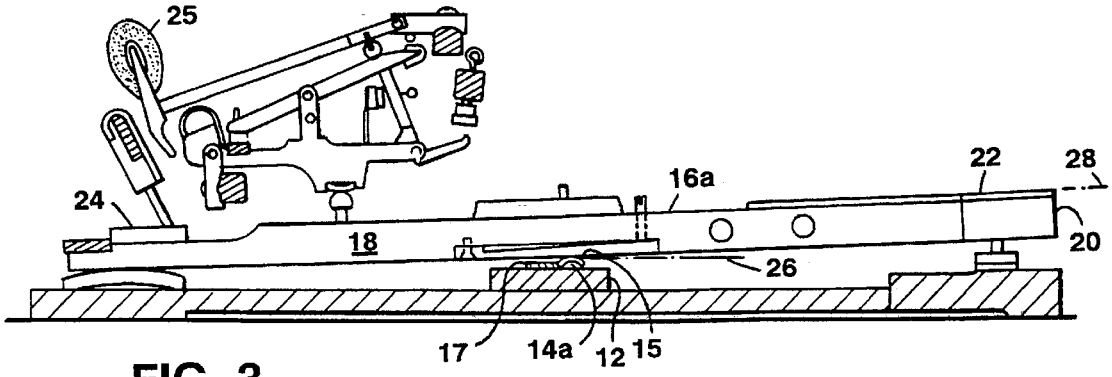
FIG. 3 is a side view, partially in section, of a piano key with key leveling of the invention.

Referring next to FIG. 3, a key **16*a* has an elongated body 18 with a first key end 20 defining a pianist actuation surface 22 and an opposite, second key end 24 positioned for actuation of a piano hammer 25 of the action stack. Key 16*a* is supported by a bearing 14*a* for pivoting movement in response to application of playing pressure applied to actuation surface 22. A balance surface 15, defined by bearing 14*a*, is disposed in a first plane 26, and actuation surface 22 is disposed in a second plane 28 vertically spaced from first plane 26**.

Figure 4:
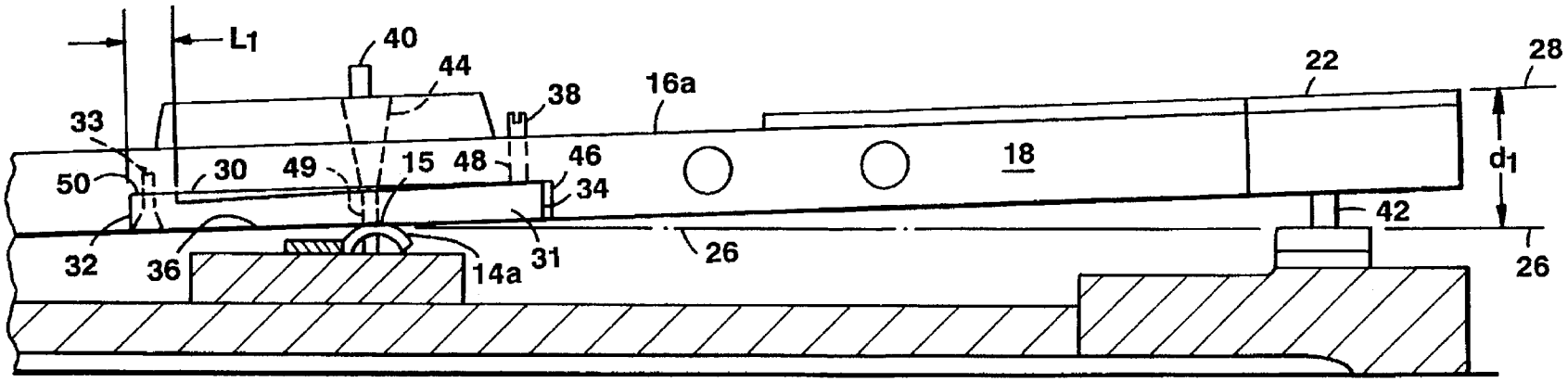
FIG. 4 is an enlarged side view, partially in section, of a piano key with key leveling of the invention shown in a first position; and FIG. **4*a*** is an enlarged side view of a piano key with key leveling of the invention shown in a second, adjusted position.

Referring now to FIG. 4, inset into a notch 30 defined by the elongated body 18 of key **16*a*** is a piano key leveling arm 31 having a first arm end 32 attached to body 18, e.g., by screw 33, and a cantilevered, second, free arm end 34. Piano key leveling arm 31 defines a leveling surface 36 in opposition to balance surface 15 of bearing 14*a*. A piano key leveling adjustment element, e.g., a screw 38 (chromed, 1 inch in length, ⅛ inch in diameter, 10–12 teeth/inch, 0.009 inch root diameter), extends generally between elongated body 18 and free arm end 34 of piano key leveling arm 31. The thread size of screw 38 is selected to permit fine adjustment without stripping the screw. Screw 38 is rotatable to adjust the vertical distance between first plane 26 of balance surface 15 and second plane 28 of playing surface 22.

Figure 4A:
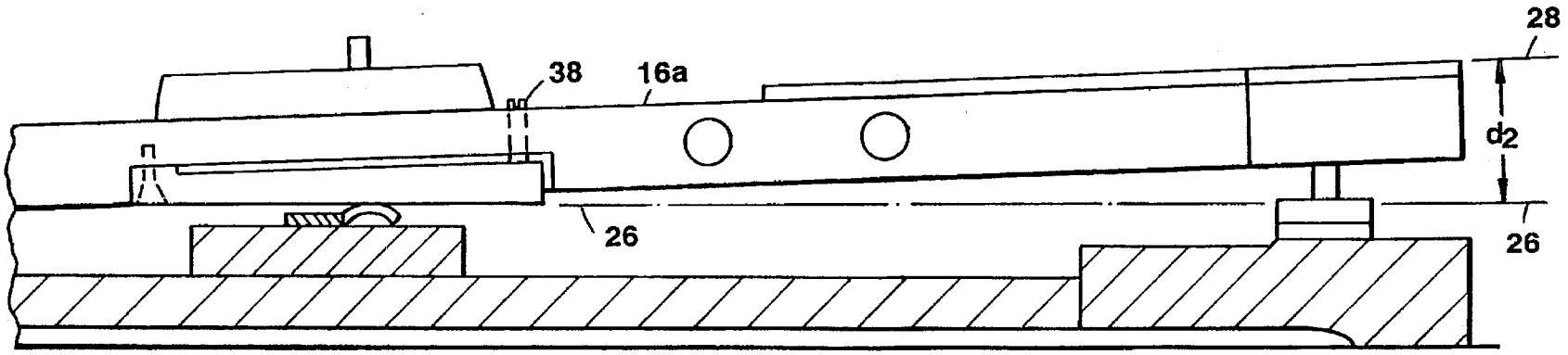

For example, as shown in FIG. 4, the distance between first plane 26 and second plane 28 is $d_1$. Referring now to FIG. 4*a*, in which screw 38 has been adjusted to raise key 16*a*, the distance between first plane 26 and second plane 28 is now $d_2$, greater than $d_1$. Thus, the key can be leveled while remaining in the piano by simply turning screw 38.

Referring again to FIG. 4, key 16*a* is held in place by a balance rail pin 40 and a front rail pin 42. A balance rail pin hole 44 defined in key stick 16*a* has a conical shape to provide clearance for balance rail pin 40 when key stick 16*a* rocks about bearing 14*a*.

Notch 30 is approximately 3.25 inches long, 0.25 inch deep and the width of key 16*a*. The notch position runs about 1.125 inch in front of balance rail pin 40 and 2.125 inch behind balance rail pin 40. Approximately 0.25 from front edge 46 of notch 30 and centered in the width of key stick 16*a*, a hole 48 is drilled in the key stick for placement of screw 38.

Piano key leveling arm 31 is generally formed from a harder wood than the spruce keys, e.g., from linear grained rock maple. A balance rail pin hole 49 may be pre-drilled in leveling arm 31 or drilled after its installment into key 16*a*. Leveling arm 31 is in face-to-face contact with the undersurface of key 16*a* in a region 50 over a length $l_1$ of about 0.5 inch and extends toward free end 34 with an upward pitch a, e.g. about 2°–4°. This helps to keep pressure against screw 38 at free arm end 34 to prevent noise. Additionally, a small piece of buck skin (approximately 0.5 inch square) may be glued to leveling arm 31 where screw 38 contacts leveling arm 31 to aid in noise prevention.

Among the advantages of the invention are the reduced leveling time. Compared to the prior art process that typically may take a seasoned technician about 45 minutes to be complete, the same task can be accomplished by an amateur following the process of the invention in about 7 to 10 minutes. Additionally, wear of the piano components is reduced. For example, since removal of the action stack is not required, the action hanger screw holes for placement of screws which hold the action stack to the key board do not wear or strip. Also, since repeated removal and replacement of the keys is not required, balance rail hole 44 does not wear, avoiding premature key chucking. Finally, since the rock maple of leveling arm 31 is a harder material than the spruce key, it can prevent or reduce compression of the spruce key and reduce effects such as warping and size change due to environmental influence.

The method of the invention also increased the accuracy of the leveling process since it allows for more exact adjustments not possible with paper punchings of a limited number of predetermined thicknesses. In addition, the method of the invention eliminates the time required to wait for paper punchings to compress or settle to be assured of the proper stable key height. What was once a tedious and time consuming process is now significantly faster and simpler.

The apparatus and method of the invention can be used with equal effectiveness during new piano manufacture and during retrofit on an existing piano. The term "piano" as used herein includes all manner of pianos and other keyed instruments.

Other embodiments are within the following claims.

What is claimed is:

1. A piano comprising:

a balance rail defining a balance surface, and at least one piano key assembly comprising:

an elongated body having a first key end defining a playing surface and an opposite, second key end positioned for actuation of a piano hammer, said at least one piano key assembly supported by said balance surface of said balance rail for pivoting movement in response to application of playing pressure applied to said playing surface, and said balance surface being disposed in a first plane and said playing surface being disposed in a second plane spaced from said first plane at a vertical distance, a piano key leveling arm having a first arm end attached to said elongated body and a cantilevered, second, free arm end, said piano key leveling arm defining a leveling surface in a region generally between said first key end and said second key end, and in a region between said first arm end and said second arm end, in opposition to said balance surface of said balance rail, and a piano key leveling adjustment element comprising a segment extending generally between said elongated body and said free arm end of said piano key leveling arm, said segment having a length adjustable for changing said vertical distance between said first plane of said balance surface and said second plane of said playing surface.

2. The piano of claim 1, wherein said leveling surface is an undersurface of said piano key leveling arm, and disposed generally beneath said elongated body.

3. The piano of claim 1, wherein said piano key leveling adjustment element comprises a screw disposed in threaded engagement with said elongated body, the length of said segment of said screw extending between said body and said free arm end of said piano key leveling arm being adjustable by rotation of said screw.

4. The piano of claim 1, wherein said balance surface is defined by an upper surface of a bearing mounted to said balance rail between said balance rail and said piano key leveling arm.

5. The piano of claim 4, wherein said bearing is integrally molded with said balance rail.

6. Method of leveling a piano key comprising:

providing a piano having a balance rail defining a balance surface, and providing at least one piano key assembly comprising an elongated body having a first key end defining a playing surface and an opposite, second key end positioned for actuation of a piano hammer, said at least one piano key assembly supported by said balance surface of said balance rail for pivoting movement in response to application of playing pressure applied to said playing surface, and said balance surface being disposed in a first plane and said playing surface being disposed in a second plane spaced from said first plane at a vertical distance, said piano key assembly further comprising a piano key leveling arm having a first arm end attached to said elongated body and a cantilevered, second, free arm end, said piano key leveling arm defining a leveling surface in a region generally between said first key end and said second key end, and in a region between said first arm end and said second arm end, in opposition to said balance surface of said balance rail, and a piano key leveling adjustment element comprising a segment extending generally between said elongated body and said free arm end of said piano key leveling arm, said segment having a length adjustable for changing said vertical distance between said first plane of said balance surface and said second plane of said playing surface, adjusting said piano key leveling adjustment element to level said piano key.

* * * * *